United States Patent [19]

MacNeille

[11] 4,195,574

[45] Apr. 1, 1980

[54] OPTICAL FUZE

[75] Inventor: Stephen M. MacNeille, Thompson, Conn.

[73] Assignee: The United States of America as represented by the Secretary of the Navy, Washington, D.C.

[21] Appl. No.: 136,983

[22] Filed: Sep. 1, 1961

[51] Int. Cl.[2] ..... F42B 5/08; F42C 13/00

[52] U.S. Cl. ..... 102/213; 250/340; 250/347

[58] Field of Search ..... 250/83.3, 340, 347; 244/14.3; 102/70.2, 213; 88/1 H

[56] References Cited

U.S. PATENT DOCUMENTS

| | | | |
|---|---|---|---|
| 2,423,885 | 7/1947 | Hammond | 250/347 |
| 2,457,393 | 12/1948 | Muffly | 102/213 |
| 2,892,093 | 6/1959 | Henderson | 102/213 |
| 3,864,566 | 2/1975 | Simpson et al. | 102/213 |
| 3,866,037 | 2/1975 | Simpson | 102/213 |

*Primary Examiner*—S. C. Buczinski

*Attorney, Agent, or Firm*—R. S. Sciascia; A. L. Branning

EXEMPLARY CLAIM

1. An infra-red detector unit adapted to be mounted on a projectile comprising a nose adaptor having at least one aperture therein, an open "O" unit mounted in said nose adaptor and having at least one aperture that is correlated with the aperture in said nose adaptor, insert means having first and second slit apertures substantially filling the aperture in said "O" unit, a reflector comprising a plurality of strips mounted in said "O" unit and having a parabolic curved surface with a first and second focal point for reflecting infra-red rays from a target source as they pass through said first and second slit apertures, first and second infra-red detecting cells mounted at the first and second focal points of said reflector, said infra-red rays passing through said first and second slit apertures and reflected by said reflector onto said first and second detecting cells thereby providing a first channel for said first infra-red detecting cell and a second channel for said second infra-red detecting cell whereby when the infra-red rays pass through the first and second channels in rapid succession during the flight of the projectile a detonating signal is generated.

7 Claims, 5 Drawing Figures

OPTICAL FUZE

This invention relates to projectiles and more particularly to an infra-red device for actuating the projectile in the lethal proximity of the target.

In shooting of shells or other artillery projectiles carrying a burst charge which is intended to burst in the air, the point of time for bursting is largely determined by a time fuze, or the like. Such a timing device has a setting which may be varied depending upon the height and trajectory of the shell. As a result of difficulties connected with the accurate estimation of time there are unavoidable sources of error in the time computing device and the variable properties of the time fuze. Another error is introduced in anticipating the height and time when firing at a fast aircraft, especially a jet.

The present invention avoids the difficulties inherent in the use of timed fuzes by bursting only when actuated by the target as it passes in close proximity thereto.

All hot objects give off infra-red rays in varying amounts. It has been discovered that a jet engine will give off a large amount of infra-red rays having a wavelength two microns or longer, and that 95% of all solar radiation energy is at wavelengths shorter than two microns. The invention as disclosed herein comprises an infra-red sensitive device mounted on a projectile for detecting infra-red rays longer than two microns. This infra-red sensitive device is so constructed that it will distinguish between a target and the sun or other source which gives off large quantities of infra-red rays.

It is an object of this invention to provide a projectile that will explode anytime it comes in close proximity to a target during flight.

Another object is to provide a fuze that is sensitive to infra-red rays of a target but will not explode when exposed to the sun.

A further object is to provide a shell having an infra-red sensitive detector with a dual sensing channel that must be energized in rapid succession to be operative.

Still another object is to provide an infra-red fuze that will distinguish between an illuminated object such as a large cloud, and a point source of infra-red rays, such as a target.

Further objects and the entire scope of the invention will become further apparent in the following detailed description and in the appended claims. The accompanying drawings display the general construction and operational principles of the invention; it is to be understood, however, that the drawings are furnished only by way of illustration and not in limitation thereof and wherein:

Figure 1:
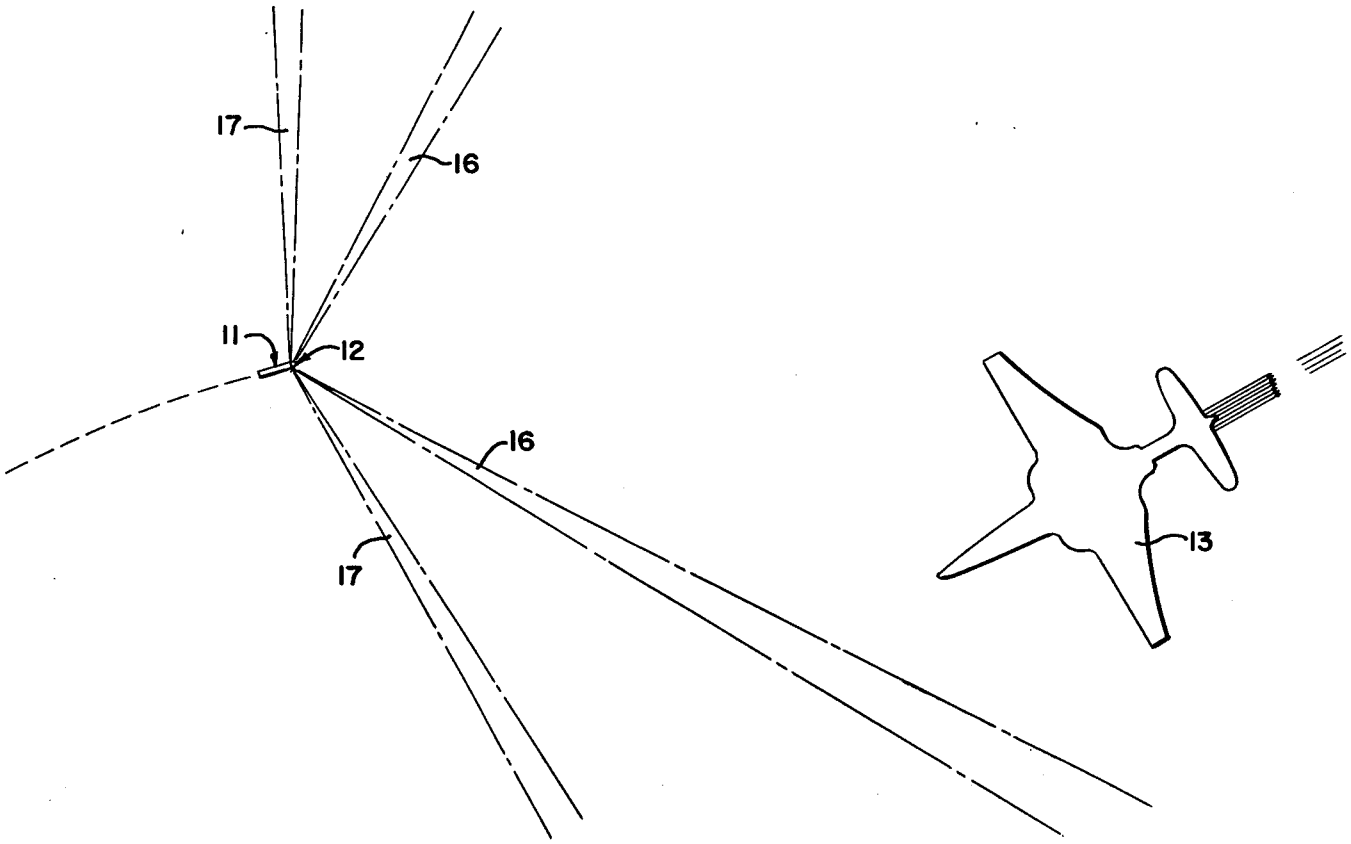
FIG. 1 is a pictorial view of a shell utilizing the infra-red detector unit entering into an infra-red field.

Referring now to the drawings, wherein like reference numerals throughout the several views, in FIG. 1 is shown a projectile 11 having an infra-red detecting device 12 entering a target field having a target 13, which is a jet aircraft. The infra-red detecting device 12 contains an optical "O" unit and has three separate apertures 14. Each window has two slits 15 for admitting infra-red rays within a 120-degree azimuth arc. The top slit views in azimuth an arc field 16 of 120 degrees at a "look" angle of 45 degrees from the longitudinal axis and the bottom slit views in azimuth an arc field 17 of 120 degrees at a "look" angle of 75 degrees from the longitudinal axis. The three apertures or sectors have a total of 360 degrees azimuth view which sweeps out two conical-shaped infra-red detecting channels, each channel having a depth of approximately six degrees.

It was recognized that in all wave-length regions of infra-red the sun could be brighter than the target, so the ability to discriminate against the sun is a basic requirement. This discrimination is accomplished by having a fuze "look" or "sweep" in one direction but at different "look" angles, substantially as shown in FIG. 1.

For the fuze to fire, it is required that the target be seen by both channels in rapid succession. The sun, since its bearing changes only with change in inclination of the shell axis, will move relatively slowly from one channel to the next.

Therefore, only those objects emitting infra-red energy and changing bearing with respect to the shell axis at a relatively fast rate will actuate the fuze.

Figure 2:
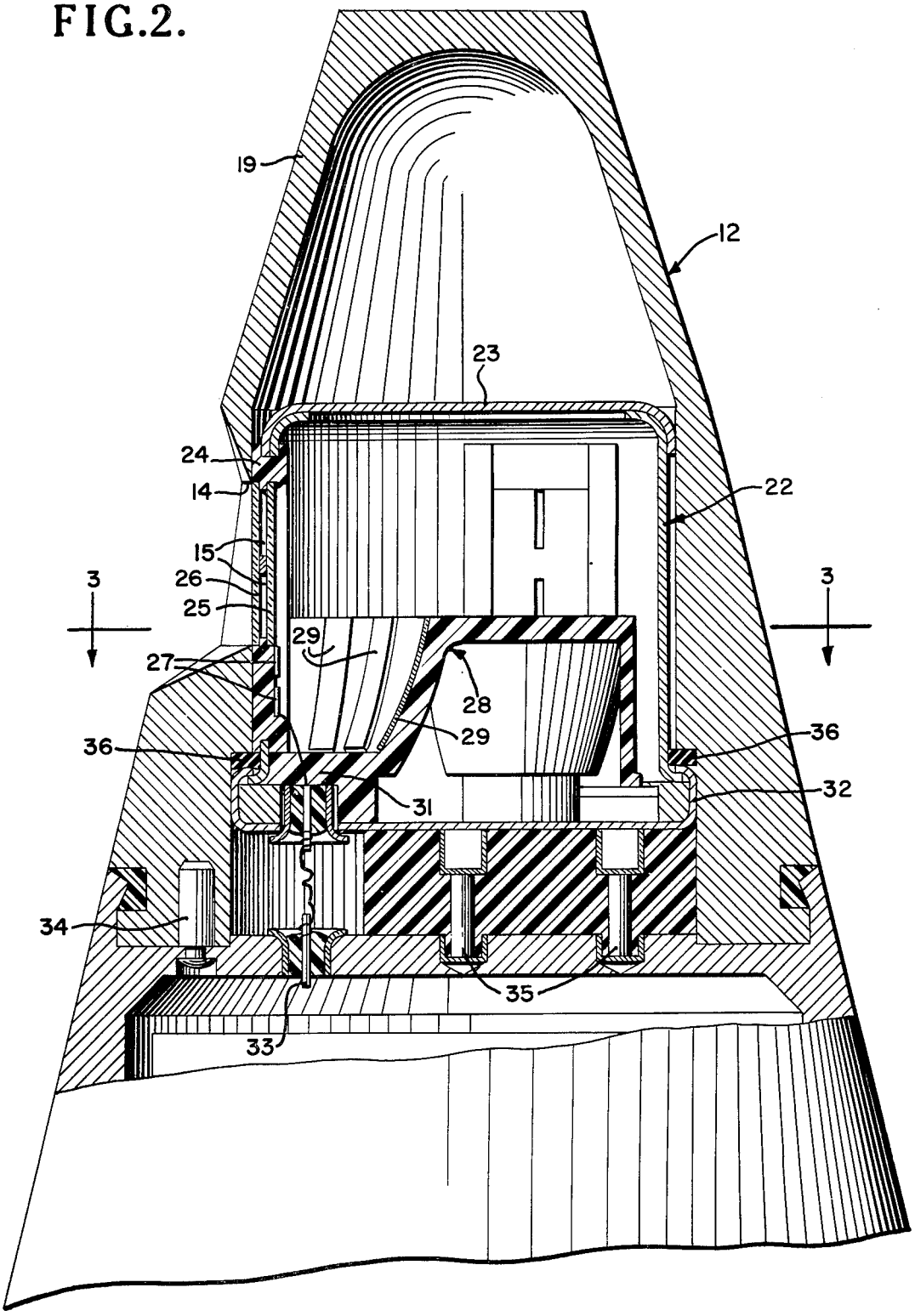
FIG. 2 illustrates a sectional view of the infra-red detector unit as shown in FIG. 1.
Figure 3:
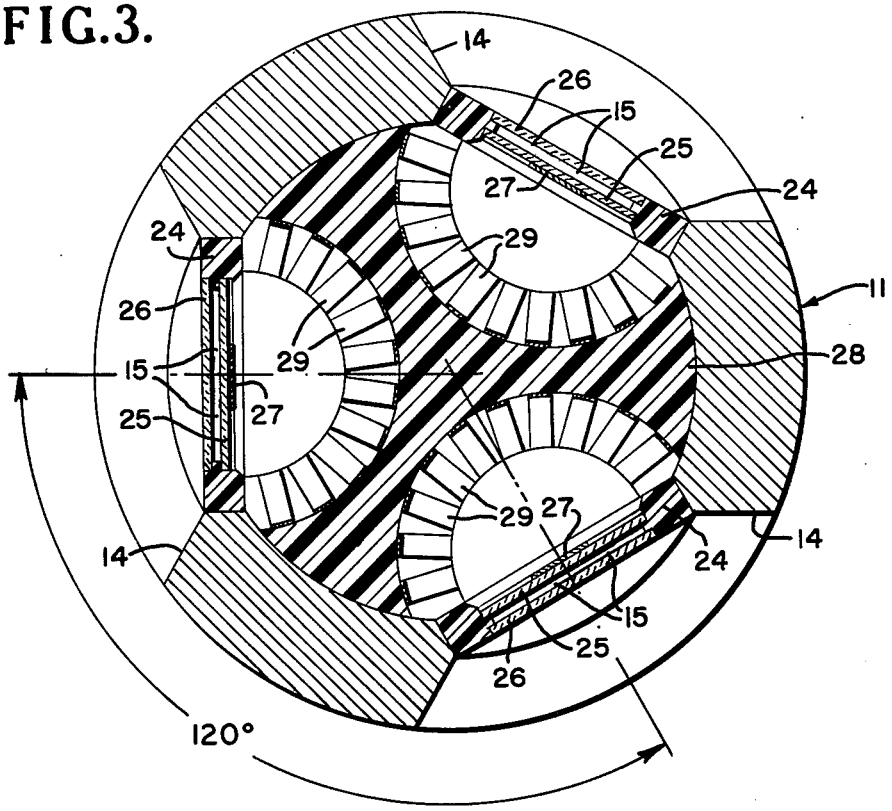
FIG. 3 illustrates a sectional view of FIG. 2 taken along line 3—3 of the infra-red reflector system and detector.

Refer now to FIG. 2 wherein the infra-red detector device 12 is mounted in the nose of projectile 11. The optical "O" unit 22 is adapted to be mounted in the nose of projectile 11 in a manner well known in the art. The protective shell of the optical "O" unit is made of steel having the shape of a can 23 with one end open to facilitate assembly and inspection. The can has three apertures therein with the centerline of each aperture located 120° from the centerline of the adjacent aperture as shown in FIG. 3. The "O" unit 22 is designed to be fitted into the nose 19 of a projectile 11, substantially as shown. A plastic insert 24 is mounted in each of the apertures with a flange that extends outside the can 23 for making contact with the apertures in the nose of the projectile. The plastic inserts 24 are molded preferably of black plexine, a thermoplastic which is opaque to infra-red. The inserts having two slits 15 properly located therein for allowing the infra-red rays to pass into the "O" unit. A glass filter 25 is cemented to the inside of the plastic insert. The glass filter will pass light rays having a wavelength of 2.6–3.2 microns. On the outside of the plastic insert is cemented a heavy piece of clear glass 26 to reinforce the insert 24 and the filter glass 25 sufficiently to withstand the air pressure encountered during firing. One of the infra-red sensitive cells 27 is cemented into place at each of the focal points of parabolic reflector 28.

The reflector 28 is of one piece construction with three parabolic surfaces, molded of black polystyrene. The reflector is shaped by a special lathe so that each parabolic curve is accurately cut and shaped to focus the light rays onto the two mounted infra-red cells. The parabolic surfaces are aluminized by evaporation techniques as is well known in the art. This provides aluminum reflecting strips 29. The reflector 28 is centered in the "O" unit 22 by shoulder 31 at the base of can 23 and is constrained axially by an integral base flange 32 clamped to the "O" unit. A notch in the reflector base flange, not shown, engages the ear on the "O" unit for angular orientation. Soldered in the integral base flange are a plurality of insulating eyelets 33 for carrying the leads from the cells 27 to the deflector and amplifier, not shown. Soldered to the base flange are two locating pins 34 and a ground stud 35.

Rubber seal 36 is located between the crimped base flange 32 and the projectile 11 to act as a shock absorber and help maintain the "O" unit in place.

Figure 4:
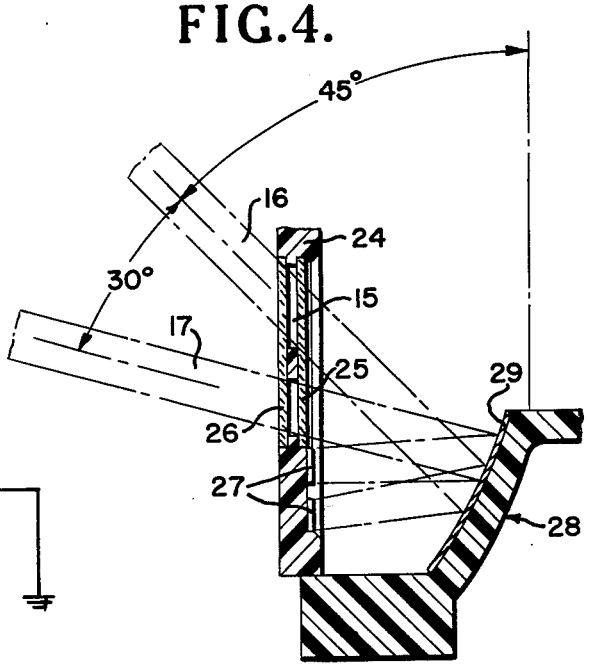
FIG. 4 is a side elevational view of one sector of the reflector illustrating the location of the slits and detector units.

The function of the "O" section is to provide both an optical system for viewing the cone-shaped fields, as shown in FIG. 1 and a sensing system for determining the type of target on which the optical system is focused. The resulting output signals from the cells are fed to the voltage detector and amplifier sections of the fuze. The window area must be kept to a minimum in order to minimize the admittance of stray light and reduce the fabricating difficulties. This has been accomplished by using the sector-type optical system of FIG. 3. The field distribution is accomplished by aluminizing the surface of reflector 28 in longitudinal strips 29 which are uniformly spaced in angle about each pair of slits on a parabolic reflector. The light into each sector is admitted through two slots in width equal to that of the infra-red cell. The top slit being focused on the bottom cell and the bottom slit being focused on the top cell substantially as shown in FIG. 4. Each sector views a segment in azimuth equal to the angle subtended by the reflector at the slit, in this case, about 120°. So, with three sectors, the full 360° of azimuth is always in view, except for alternate blank segments in each sector as hereinafter described. In each of the three sectors the top slit and the bottom portion of the reflector are used to form the top channel which is inclined at a "look" angle 45° from the axis of the projectile. The bottom channel is inclined at a "look" angle at 75° from the axis of the projectile. Each upper and lower channel has a depth of about six degrees.

Each sector has 10 sensitive segments, each segment covering six degrees in azimuth. These segments are in uniform alteration with 10 blank segments in each sector.

Figure 5:
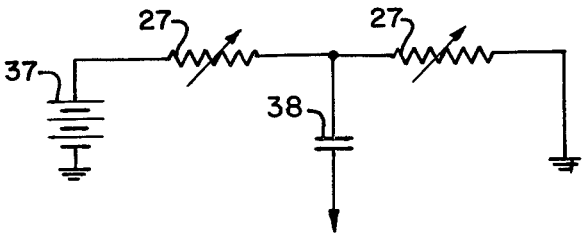
FIG. 5 is a schematic of an electrical circuit suitable for use with the detector units.

In FIG. 5 is an equivalent circuit with the infra-red cells 27 being shown as variable resistors connected in series with a source of power 37. The source of power will supply current continuously to the circuit. The impedance of the infra-red cell is reduced when it is activated by a source of infra-red rays. The resulting voltage signal will be passed by the condenser 38 connected at the midpoint between the two cells to a voltage detector and an amplifier (not shown).

The shell rotates about 200 cycles per second during flight. If the shell enters a target field a strong modulated signal would result from the rotation of the shell; that is, $200 \times 30 = 6{,}000$ cycles per second.

By connecting the infra-red detecting cells in opposition as shown in FIG. 5, a voltage is generated as the fuze passes an infra-red target. The lower cell first generates a positive 6,000-cycle voltage and the upper cell then generates a negative 6,000-cycle voltage. Thus, the amplitude of the resulting voltage is twice that for a single detector which is sufficient to detonate the projectile.

Should both channels of the infra-red detector be activated at the same time by a large cloud formation, etc., the voltage signals would merely cancel. Radiation scatter within the reflector system is also canceled because both detectors will be indicated about an equal amount.

Obviously many modifications and variations of the present invention are possible in the light of the above teachings. It is therefore to be understood that within the scope of the appended claims the invention may be practiced otherwise than as specifically described.

Having thus described the invention, what is claimed is:

1. An infra-red detector unit adapted to be mounted on a projectile comprising a nose adaptor having at least one aperture therein, an open "O" unit mounted in said nose adaptor and having at least one aperture that is correlated with the aperture in said nose adaptor, insert means having first and second slit apertures substantially filling the aperture in said "O" unit, a reflector comprising a plurality of strips mounted in said "O" unit and having a parabolic curved surface with a first and second focal point for reflecting infra-red rays from a target source as they pass through said first and second slit apertures, first and second infra-red detecting cells mounted at the first and second focal points of said reflector, said infra-red rays passing through said first and second slit apertures and reflected by said reflector onto said first and second detecting cells thereby providing a first channel for said first infra-red detecting cell and a second channel for said second infra-red detecting cell whereby when the infra-red rays pass through the first and second channels in rapid succession during the flight of the projectile a detonating signal is generated.

2. A spin type projectile having a charge to be exploded in close proximity of a target that emits infra-red rays comprising an infra-red detector device mounted in the nose of the projectile having a first channel and second channel respectively defining first and second "look"angles, a detonating voltage being generated only when said channels are energized in proper sequence, said detector device including an "0" unit having at least three apertures, three inserts opaque to infra-red rays, each aperture being substantially filled with one of said inserts, each of said inserts having a first slit aperture and a second slit aperture for allowing infra-red rays to pass at a predetermined angle with respect to the longitudinal axis of the projectile, a reflector having three parabolic reflecting surfaces, each parabolic reflecting surface having first and second focal points which are correlelated with said first and second slit apertures, respectively, six infra-red detectors, one each of said infra-red detectors being respectively located at each of the first and second focal points of each of the parabolic reflecting surfaces, said infra-red rays passing through each of said first slit apertures and reflected by a respective reflecting surface onto a respective first detector providing a first channel with a first "look" angle, said infra-red rays also passing through each of said second slit apertures and reflected by a respective reflecting surface onto a respective second detector providing a second channel with a second "look" angle as the projectile spins about its axis.

3. A projectile of claim 2 wherein said infra-red detectors located at the first focal point in each of the parabolic reflectors have a "look" angle at 45° with respect to the axis of the projectile.

4. A projectile of claim 2 wherein said infra-red detectors located at the second focal point in each of the parabolic reflectors form a continuous "look" angle at 75° with respect to the axis of the projectile.

5. A projectile responsive to infra-red rays of a target comprising a plurality of inserts each having a first aperture and a second slit aperture, each insert being located equidistantly from adjacent identical inserts around the nose of the projectile, filter means located in close proximity to said apertures for passing only the desired infra-red rays, reflector means having a plurality of parabolic reflecting surfaces for reflecting and concentrating the infra-red rays from the first and second apertures to first and second focal points, respectively, first and second infra-red detectors located at the first and second focal points, respectively, said infra-red rays passing through said first and second slit apertures and reflected by said reflector means onto said first and second detectors thereby providing a first channel and a second channel with respective first and second "look" angles of approximately 30° separation therebetween.

6. A projectile responsive to infra-red rays of a target comprising a casing having three apertures located circumferentially in the nose thereof, each aperture substantially being spaced equidistant from the adjacent apertures, three opaque inserts respectively located in and substantially closing said apertures, each of said inserts having first and second slit apertures in parallel relation to the longitudinal axis of said casing, multi-reflecting means mounted in said casing, six infra-red detecting and sensing devices, said infra-red rays passing through said first and second slit apertures of each insert and reflected by said multi-reflecting means onto said six infra-red detecting devices in predetermined sequential order thereby forming first and second conical-shaped infra-red detecting channels, circuit means connecting the infra-red detecting devices whereby when an infra-red emitting target passes through the first and second channels in sequence a signal voltage is generated by the detecting devices to detonate the projectile.

7. A projectile as recited in claim 6 wherein the circuit means includes a direct current source of power having a positive terminal and a negative terminal, each of the infra-red detectors for said first and second slit apertures being connected serially to said source of power between said positive and negative terminals, and in reverse polarity with respect to each other, capacitor means connected at a junction between each of said infra-red detectors for isolating the direct current from said source and passing any signal voltage generated by said detectors.

* * * * *